US006279547B1

(12) United States Patent
Mancini et al.

(10) Patent No.: US 6,279,547 B1
(45) Date of Patent: Aug. 28, 2001

(54) FUEL VAPOR EMISSION CONTROL SYSTEM EMPLOYING FUEL VAPOR TANK

(75) Inventors: Douglas Joseph Mancini, Farmington; Thomas C. Crowley, Novi; Thomas Edwin Pearson, Redford, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/563,425

(22) Filed: May 3, 2000

(51) Int. Cl.[7] ..... F02M 33/04
(52) U.S. Cl. ..... 123/516; 123/518
(58) Field of Search ..... 123/516, 518, 123/519, 520

(56) References Cited

U.S. PATENT DOCUMENTS

| | | | | |
|---|---|---|---|---|
| 4,829,968 | | 5/1989 | Onufer . | |
| 4,886,096 | * | 12/1989 | Reddy | 123/518 |
| 5,014,742 | | 5/1991 | Covert et al. . | |
| 5,054,528 | | 10/1991 | Saitoh . | |
| 5,146,902 | * | 9/1992 | Cook et al. | 123/519 |
| 5,239,824 | | 8/1993 | Matsumoto . | |
| 5,275,145 | | 1/1994 | Tuckey . | |
| 5,297,529 | * | 3/1994 | Cook et al. | 123/520 |
| 5,305,724 | | 4/1994 | Chikamatsu et al. . | |
| 5,456,238 | | 10/1995 | Horiuchi et al. . | |
| 5,460,141 | * | 10/1995 | Denz et al. | 123/520 |
| 5,730,107 | * | 3/1998 | Blumenstock | 123/520 |
| 5,826,565 | | 10/1998 | Mueller et al. . | |
| 5,915,364 | | 6/1999 | Katou et al. . | |
| 5,934,260 | | 8/1999 | Gadkaree et al. . | |
| 5,987,968 | * | 11/1999 | Cook et al. | 123/520 |
| 6,014,958 | * | 1/2000 | Miwa et al. | 123/520 |
| 6,196,202 | * | 3/2001 | Busato et al. | 123/520 |

* cited by examiner

*Primary Examiner*—Thomas N. Moulis
(74) *Attorney, Agent, or Firm*—Jerome Drouillard

(57) ABSTRACT

A fuel system, a method for operating the fuel system and a method for operating an engine which is supplied by the fuel system each comprise: (1) a fuel tank; (2) a fuel vapor tank in fluid communication with the fuel tank by means of a first fuel vapor conduit; and (3) an engine in fluid communication with the fuel vapor tank by means of a second fuel vapor conduit. Within each of the fuel system and the two methods, there is captured, contained and compressed within the fuel vapor tank a fuel vapor extracted from the fuel tank when either: (1) refueling the fuel tank whether or not the engine is operating; (2) when the engine is operating whether or not refueling the fuel tank; or (2) immediately after shutting down the engine after having operated the engine. The fuel vapor within the fuel vapor tank may then be employed alone for restarting the engine, in absence of liquid fuel from the fuel tank.

9 Claims, 1 Drawing Sheet

FUEL VAPOR EMISSION CONTROL SYSTEM EMPLOYING FUEL VAPOR TANK

BACKGROUND OF THE INVENTION

1. Field of the Invention

The present invention relates generally to fuel vapor emission control for internal combustion engines. More particularly, the present invention relates fuel tank fuel vapor emission control for internal combustion engines.

2. Description of the Related Art

Modern transportation vehicles which employ a liquid fuel conventionally also employ for storage of the liquid fuel a fuel tank. Similarly, since most liquid fuels are highly volatile, such a fuel tank typically contains in addition to the liquid fuel a fuel vapor. A concentration of fuel in the fuel vapor within the fuel tank is generally related to a temperature of the liquid fuel within the fuel tank and a temperature of the fuel vapor within the fuel tank.

While a fuel vapor within a fuel tank does not typically impair operation of a transportation vehicle which is powered by an engine which employs a liquid fuel extracted from the fuel tank, upon refueling of the fuel tank with additional liquid fuel the fuel vapor must of necessity be displaced. For environmental protection purposes and for economic reasons, it is desirable for such displaced fuel vapor not to be released into the atmosphere.

Various apparatus, systems and methods have been disclosed within the art of fuel system design for attenuating, upon refueling of a fuel tank, release of a fuel vapor into the atmosphere. Well known in this regard are fuel system designs which incorporate the use of carbon filled fuel vapor retention canisters for cyclical absorptive capture and desorptive controlled release of a fuel vapor displaced incident to refueling of a fuel tank. Examples of such fuel system designs are disclosed within U.S. Pat. No. 4,829,968, U.S. Pat. No. 5,014,742, U.S. Pat. No. 5,054,528, U.S. Pat. No. 5,239,824, U.S. Pat. No. 5,275,145, U.S. Pat. No. 5,305,724, U.S. Pat. No. 5,456,238, U.S. Pat. No. 5,826,565, U.S. Pat. No. 5,915,364 and U.S. Pat. No. 5,934,260, all of which are incorporated herein fully by reference.

While any of the foregoing disclosed fuel system designs provides upon refueling of a fuel tank with a liquid fuel an attenuated displaced fuel vapor release into the atmosphere, such desirable result is often achieved only with complicated piping and valving schemes, or often achieved only while still encountering fuel vapor canister breathing or dissipation losses with respect to a carbon filled fuel vapor retention canister which is either open to the atmosphere or vented to the atmosphere.

There thus exists within the art of fuel system design a continuing need for comparatively simple apparatus, systems and methods for attenuating upon refueling of a fuel tank release of a displaced fuel vapor into the atmosphere.

It is towards that object that the present invention is directed.

SUMMARY OF THE INVENTION

In order to realize the object towards which the present invention is directed, the present invention provides in a first instance a fuel system comprising: (1) a fuel tank; (2) a fuel vapor tank in fluid communication with the fuel tank by means of a first fuel vapor conduit; and (3) an engine in fluid communication with the fuel vapor tank by means of a second fuel vapor conduit. The fuel system also comprises: (1) a fuel vapor pump and a first fuel vapor valve contained within the first fuel vapor conduit and interposed between the fuel tank and the fuel vapor tank; and (2) a second fuel vapor valve contained within the second fuel vapor conduit and interposed between the fuel vapor tank and the engine.

Incident to operation of the fuel system of the present invention, either: (1) when the fuel tank is being refueled and regardless whether or not the engine is operating; (2) when the engine is operating and regardless whether or not the fuel tank is being refueled; or (3) after the engine has been shut down after having been operated, the first fuel vapor valve is opened and the fuel vapor pump is energized such that a fuel vapor is extracted from the fuel tank and captured, contained and compressed within the fuel vapor tank. Similarly, incident to operation of the fuel system of the present invention, and under conditions when the engine is operating and regardless whether or not the fuel tank is being refueled, the second fuel vapor valve is opened to allow extraction of a moderated flow of fuel vapor from the fuel vapor tank into the engine.

Within the present invention, the fuel vapor tank is neither vented to, nor in fluid communication with, the atmosphere, rather, the fuel vapor tank is generally pressurized with a fuel vapor extracted from the fuel tank.

Finally, the fuel system of the present invention provides particular advantage in operation of an engine whose fuel is supplied by the fuel system of the present invention insofar as there may be employed when starting the engine only fuel vapor from the fuel vapor tank, in absence of liquid fuel from the fuel tank, such that there may be attenuated upon a cold starting of the engine incompletely combusted hydrocarbon emissions from the engine which are unlikely to be converted to less polluting exhaust gases by a catalytic convertor which has yet to achieve operating temperature.

BRIEF DESCRIPTION OF THE DRAWING

The objects, features and advantages of the present invention are understood within the context of the Description of the Preferred Embodiment, as set forth below. The Description of the Preferred Embodiment is understood within the context of the accompanying drawing, which forms a material part of this disclosure, wherein.

DESCRIPTION OF THE PREFERRED EMBODIMENT

Figure 1:
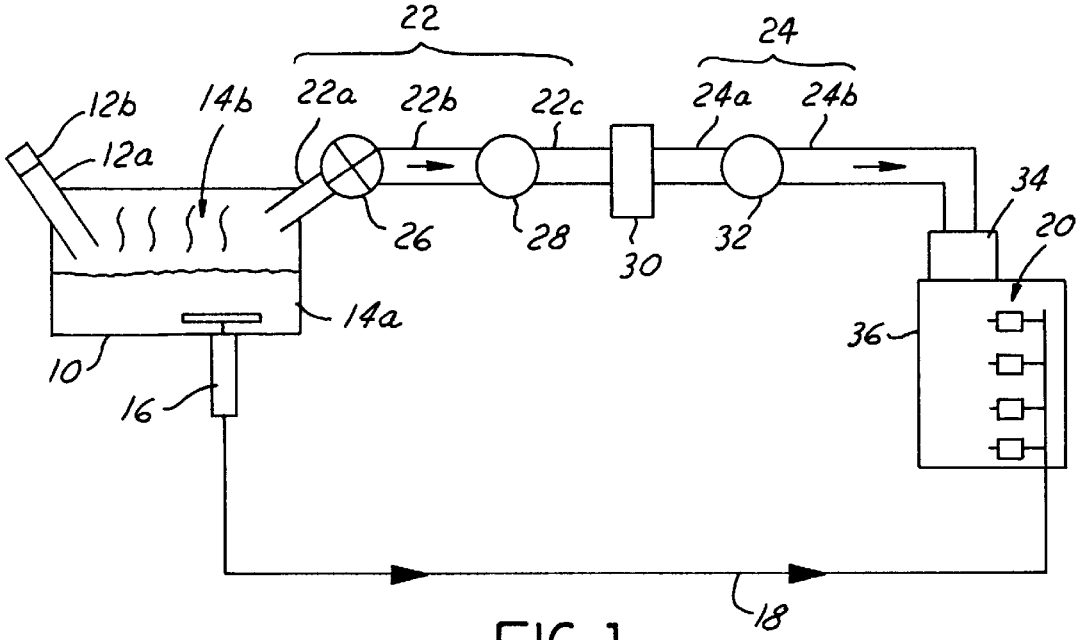
FIG. 1 shows a schematic diagram of a fuel system fabricated in accord with a preferred embodiment of the present invention.

Referring now to FIG. 1, there is shown a schematic diagram of a fuel system fabricated in accord with a preferred embodiment of the present invention.

Shown in FIG. 1 is a fuel tank 10 having formed integral thereto a fuel filler pipe 12*a* which is enclosed with a fuel filler cap 12*b*. Also shown within FIG. 1, and contained within the fuel tank 10, is a liquid fuel 14*a* having formed thereover a fuel vapor 14*b* which is typically formed incident to vaporization of the liquid fuel 14*a* within the fuel tank 10.

As is illustrated within FIG. 1 with respect to the liquid fuel 14*a* within the fuel tank 10, the liquid fuel 14*a* within the fuel tank 10 is extracted by means of a fuel pump 16 and supplied through a liquid fuel line 18 to a series of fuel injectors 20 which supply the liquid fuel 14*a* to fuel an engine 36.

As is also illustrated within the schematic diagram of FIG. 1 with respect to the fuel vapor 14*b* within the fuel tank 10, the fuel vapor 14*b* is transported: (1) from the fuel tank 10 through a first fuel vapor conduit 22, which is comprised of a series of first fuel vapor sub-conduits 22*a*, 22*b* and 22*c*, to a fuel vapor tank 30; and then (2) from the fuel vapor tank 30 through a second fuel vapor conduit 24, which is comprised of a pair of second fuel vapor sub-conduits 24*a* and 24*b*, to an intake manifold 34 which also comprises a portion of the engine 36.

As is similarly also illustrated within the schematic diagram of FIG. 1, there is fabricated within the first fuel vapor conduit 22 and separated by the series of first fuel vapor sub-conduits 22*a*, 22*b* and 22*c*, while being interposed between the fuel tank 10 and the fuel vapor tank 30, a fuel vapor pump 26 and a first fuel vapor valve 28. Similarly there is also illustrated within the schematic diagram of FIG. 1 fabricated within the second fuel vapor conduit 24 and separated by the pair of second fuel vapor sub-conduits 24*a* and 24*b*, while being interposed between the fuel vapor tank 30 and the intake manifold 34, a second fuel vapor valve 32.

Although the schematic diagram of FIG. 1 illustrates the fuel vapor pump 26, in comparison with the first fuel vapor valve 28, as being fabricated within the first fuel vapor conduit 22 closer to the fuel tank 10 than the fuel vapor tank 30, a reverse ordering fabrication of the fuel vapor pump 26 and the first fuel vapor valve 28 with respect to both the fuel tank 10 and the fuel vapor tank 30 is also contemplated within the context of the fuel system of the preferred embodiment of the present invention.

Similarly, although not specifically illustrated within the schematic diagram of FIG. 1, the fuel system of the present invention also contemplates that there is employed a flow controlling orifice interposed between the fuel vapor tank 30 and the engine 36 in any of several locations, including but not limited to: (1) integral with an exit port of the fuel vapor tank 30; (2) integral with the second fuel vapor valve 32; (3) integral with the manifold 34; or (4) as a separate independent component within the second fuel vapor conduit 24.

Within the preferred embodiment of the fuel system of the present invention, the fuel vapor pump 26, the first fuel vapor valve 28 and the fuel vapor tank 30 are sized such that upon refueling of the fuel tank 10 with an additional quantity of a liquid fuel, such as the liquid fuel 14*a* , all of the fuel vapor 14*b* displaced upon such refueling may be timely captured, contained and compressed within the fuel vapor tank 30, without release of any of the fuel vapor 14*b* so displaced into the atmosphere.

Similarly, within the present invention and the preferred embodiment of the present invention the fuel vapor tank 30 is neither vented to, nor in fluid communication with, the atmosphere, but rather the fuel vapor tank 14 is typically pressurized with the fuel vapor 14*b*.

Finally, within the present invention and the preferred embodiment of the present invention, there is typically and preferably absent within the fuel system whose schematic diagram is illustrated in FIG. 1 a carbon filled fuel vapor retention canister.

While the schematic diagram of FIG. 1 illustrates a fuel system in accord with the preferred embodiment of the present invention, also important to the present invention and the preferred embodiment of the present invention is a method through the fuel system whose schematic diagram is illustrated in FIG. 1 operates.

In that regard, and in a first instance when the engine 36 has not been operating (i.e., the engine is dormant) and the fuel tank 10 is not being refueled, both the first fuel vapor valve 28 and the second fuel vapor valve 32 are in a closed position such that there is captured, contained and compressed within the fuel vapor tank 30 a quantity of fuel vapor 14*b*.

Next, under conditions when the engine 36 is operating, whether or not the fuel tank 10 is being refueled, the second fuel vapor valve 32 is opened such as to allow a flow of the fuel vapor 14*b* which is captured, contained and compressed within the fuel vapor tank 30 to flow to the engine 36 incident to either or both: (1) an elevated pressure within the fuel vapor tank 30; or (2) a vacuum within the manifold 34, the flow being limited by the flow controlling orifice as is discussed above, such flow controlling orifice not being otherwise illustrated within the schematic diagram of FIG. 1.

Next, under conditions generally immediately after the engine 36 is shut down, and whether or not the fuel tank is being refueled, the second fuel vapor valve 32 is closed, the first fuel vapor valve 28 is opened and the fuel vapor pump 26 is energized such that an amount of fuel vapor 14*b* is extracted from the fuel tank and captured, contained and compressed within the fuel vapor tank 30. After such an amount of fuel vapor 14*b* is captured, contained and compressed within the fuel vapor tank 30, which will typically also provide the fuel tank 10 at or below atmospheric pressure, the first fuel vapor valve 28 is closed and the fuel vapor pump 26 is de-energized.

Finally, under conditions when: (1) the fuel tank 10 is being refueled, and whether or not the engine 36 is operating; or (2) the engine 36 is operating, and whether or not the fuel tank 10 is being refueled, the first fuel vapor valve 28 is also opened and the fuel vapor pump 26 is also energized such as to remove the fuel vapor 14*b* from the fuel tank 10 while capturing, containing and compressing the fuel vapor 14*b* within the fuel vapor tank 30. Such refueling of the fuel tank 10, opening of the first fuel vapor valve 28 and energizing of the fuel vapor pump 26 may be triggered by a refueling event such as but not limited to a fuel filler door opening refueling event, a fuel filler cap removal refueling event, a fuel pump nozzle insertion refueling event, a quantity of liquid fuel introduction into the fuel tank 10 as a refueling event or any other refueling event as is known in the art of refueling a fuel tank.

As is understood by a person skilled in the art, the present invention provides particular advantage insofar as by employing within the context of the present invention the fuel vapor tank 30 for capturing, containing and compressing the fuel vapor 14*b* either incident to refueling of the fuel tank 10 or during operation of the engine 36, or more particularly after shutting down the engine 36, the engine 36 when subsequently restarted and when cold may be restarted while employing only the fuel vapor 14*b* from within the fuel vapor tank 30 and not employing any of the liquid fuel 14*a* from within the fuel tank 10. Use of only the fuel vapor 14*b* when starting the engine 36 when cold is desirable insofar as such circumstances provide for a reduction in hydrocarbon emissions which would otherwise result from incompletely combusted liquid fuel which is unable to be completely converted to less polluting exhaust gases under circumstances where a catalytic convertor connected to an exhaust gas stream from the engine 36 has not yet achieved operational temperature.

As is understood by a person skilled in the art, the preferred embodiment of the invention is illustrative of the present invention rather than limiting of the present invention. Revisions and modifications may be made to materials, components and dimensions through which is fabricated and operated a fuel system in accord with the preferred embodiment of the present invention while still fabricating and operating a fuel system in accord with the present invention, further in accord with the appended claims.

What is claimed is:

1. A fuel system comprising:

a fuel tank;

a fuel vapor tank in fluid communication with the fuel tank by means of a first fuel vapor conduit;

an engine in fluid communication with the fuel vapor tank by means of a second fuel vapor conduit;

a fuel vapor pump and a first fuel vapor valve contained within the first fuel vapor conduit and interposed between the fuel tank and the fuel vapor tank; and a second fuel vapor valve contained within the second fuel vapor conduit and interposed between the fuel vapor tank and the engine.

2. The fuel system of claim 1 wherein the fuel vapor tank is neither vented to, nor in fluid communication with, the atmosphere.

3. The fuel system of claim 1 wherein the fuel system does not comprise a carbon filled fuel vapor retention canister.

4. A method for refueling a fuel tank comprising:

providing a fuel system comprising:

a fuel tank having contained therein a liquid fuel and a fuel vapor;

a fuel vapor tank in fluid communication with the fuel tank by means of a first fuel vapor conduit; and an engine in fluid communication with the fuel vapor tank by means of a second fuel vapor conduit;

capturing, containing and compressing within the fuel vapor tank a quantity of the fuel vapor extracted from the fuel tank when at least either:

the fuel tank is being refueled with an additional quantity of a liquid fuel whether or not the engine is operating;

the engine is operating whether or not the fuel tank is being refueled; or the engine is shut down after having been operated.

5. The method of claim 4 wherein the fuel vapor tank is neither vented to, nor in fluid communication with, the atmosphere.

6. The method of claim 4 wherein the fuel system does not comprise a carbon filled fuel vapor retention canister.

7. A method for operating an engine comprising:

providing a fuel system comprising:

a fuel tank having contained therein a liquid fuel and a fuel vapor;

a fuel vapor tank in fluid communication with the fuel tank by means of a first fuel vapor conduit; and an engine in fluid communication with the fuel vapor tank by means of a second fuel vapor conduit;

capturing containing and compressing within the fuel vapor tank a quantity of the fuel vapor extracted from the fuel tank when at least either:

the fuel tank is being refueled with an additional quantity of a liquid fuel whether or not the engine is operating;

the engine is operating whether or not the fuel tank is being refueled; or the engine is shut down after having been operated; and restarting the engine while employing only the quantity of fuel vapor from the fuel vapor tank and not the liquid fuel from the fuel tank.

8. The method of claim 7 wherein the fuel vapor tank is neither vented to, nor in fluid communication with, the atmosphere.

9. The method of claim 7 wherein the fuel system does not comprise a carbon filled fuel vapor retention canister.

* * * * *